US010260180B2

(12) United States Patent
Chan

(10) Patent No.: US 10,260,180 B2
(45) Date of Patent: Apr. 16, 2019

(54) FABRICATION PROCESS FOR MANUFACTURING A KNITTING PIECE

(71) Applicant: Yi Shiang Chan, Zhongshan (CN)

(72) Inventor: Yi Shiang Chan, Zhongshan (CN)

( * ) Notice: Subject to any disclaimer, the term of this patent is extended or adjusted under 35 U.S.C. 154(b) by 318 days.

(21) Appl. No.: 15/257,838

(22) Filed: Sep. 6, 2016

(65) Prior Publication Data

US 2017/0356106 A1 Dec. 14, 2017

(30) Foreign Application Priority Data

Jun. 12, 2016 (CN) ..... 2016 1 0411360

(51) Int. Cl.

| | |
|---|---|
| ***D05C 17/00*** | (2006.01) |
| ***D04B 35/02*** | (2006.01) |
| ***D04B 17/00*** | (2006.01) |
| ***D04B 21/16*** | (2006.01) |

(52) U.S. Cl.

CPC ..... *D04B 35/02* (2013.01); *D04B 17/00* (2013.01); *D04B 21/165* (2013.01); *D05C 17/00* (2013.01); *D10B 2401/024* (2013.01)

(58) Field of Classification Search

CPC ..... D05C 17/00; A41D 27/08

USPC ..... 112/475.18, 475.19, 439

See application file for complete search history.

(56) References Cited

U.S. PATENT DOCUMENTS

| | | | | |
|---|---|---|---|---|
| 3,463,692 | A * | 8/1969 | Brunner | A61F 2/68 112/439 |
| 4,788,922 | A * | 12/1988 | Clarius | D05C 17/00 112/403 |
| 5,111,760 | A * | 5/1992 | Garzone, Jr. | D06Q 1/005 112/403 |
| 5,241,919 | A * | 9/1993 | LaGreca | D05C 17/00 112/410 |
| 6,263,817 | B1 * | 7/2001 | Tajima | D05C 17/00 112/439 |
| 6,321,672 | B1 * | 11/2001 | Dudek, II | D05C 17/00 112/439 |
| 7,104,208 | B2 * | 9/2006 | Waterfield | D05C 7/00 112/439 |
| 2010/0035029 | A1 * | 2/2010 | Ngo | D06P 5/003 428/196 |
| 2011/0041741 | A1 * | 2/2011 | Cohen | D05C 17/00 112/439 |
| 2017/0072669 | A1 * | 3/2017 | Sekido | B32B 27/36 |

* cited by examiner

*Primary Examiner* — Tajash D Patel

(74) *Attorney, Agent, or Firm* — Don D. Cha; Hamilton DeSanctis & Cha, LLP

(57) ABSTRACT

The present invention discloses a fabrication process for manufacturing a knitting piece, which comprises the following steps: (a) preparing a base material: firstly preparing a base material, and then placing the base material on an textile machine; (b) performing piece knitting: embroidering a corresponding pattern on the base material by the textile machine according to a set program, thereby obtaining a desirable semi-finished knitting piece; and (c) dissolving the base material: taking down the semi-finished knitting piece obtained in step (b), then processing the semi-finished knitting piece and dissolving to remove the base material in the semi-finished knitting piece, thereby obtaining a finished knitting piece.

6 Claims, No Drawings

FABRICATION PROCESS FOR MANUFACTURING A KNITTING PIECE

FIELD OF THE INVENTION

The present invention relates to the field of textiles, and in particular to a fabrication process for manufacturing a knitting piece.

BACKGROUND OF THE INVENTION

All traditional fabric weaving processes (comprising knitting, wool weaving or plain weaving) are limited to warp and weft weaving methods, which resulting in less pattern changes of the fabrics and simple structures of woven products. Therefore, requirements of a user on the fabrics with various pattern changes cannot be satisfied.

SUMMARY OF THE INVENTION

In order to solve the above problems, an object of the present invention is to provide a fabrication process for manufacturing a knitting piece, which is simple and may knit knitting pieces with different patterns as required.

A technical solution adopted by the present invention to solve the problems is as follows.

A fabrication process for manufacturing a knitting piece comprises the following steps:

(a) placing a soluble base material on a textile machine;

(b) embroidering a corresponding pattern on said base material using said textile machine according to a set program to produce a desirable semi-finished knitting piece; and (c) removing said soluble base material from said semi-finished knitting piece to obtain a desirable finished knitting piece.

As an improvement to the technical solution, the base material prepared in the step (a) is a lump made of hydrosol, and after taking down the semi-finished knitting piece from the textile machine in the step (c), placing the semi-finished knitting piece into water or an aqueous solution to dissolve and separate the base material from the semi-finished knitting piece.

As an improvement to the above technical solution, in the step (c), the water or aqueous solution has a temperature of 5-40° C. when the semi-finished knitting piece is put into the water or aqueous solution, and the semi-finished knitting piece is soaked in the water or aqueous solution for a period of 5-600 s.

In the present invention, the base material prepared in the step (a) is a hot-melt interlining cloth. After being took down the semi-finished knitting piece from the textile machine in the step (c), the semi-finished knitting piece is soaked in hot water or aqueous solution to dissolve and separate the base material from the semi-finished knitting piece.

Preferably, in the step (c), the hot water or aqueous solution has a temperature of 30-50° C. when the semi-finished knitting piece is put into the water or aqueous solution, and the soaking time is 30-1200 s.

Further, knitting threads used during the piece knitting by the textile machine in the step (b) are one or more of pure spinning yarn, blended yarn, ornamental thread, rope, webbing and stabilized yarn.

The present invention has the following beneficial effects: since the textile machine is adopted to embroider on the base material in the present invention, limitations of a warp and weft weaving method of a traditional weaving process are avoided, so that any changes of lines, color blocks, textures or multi-level overlapped pattern cloth pieces can be knitted, thus the manufactured knitting piece is diversified in patterns and can meet requirements of different users on pattern changes. Meanwhile, the base material can be removed by dissolution, so that the embroidered patterns on the knitting piece may be formed to various effects, such as hollow, pierced, stereoscopic or stabilized and the likes, to obtain diverse finished knitting pieces.

DETAILED DESCRIPTION OF THE INVENTION

Generally speaking, the present invention is directed to a fabrication process for manufacturing a knitting piece comprises the following steps:

(a) preparing a base material: firstly preparing a soluble base material, and then placing the base material on an textile machine, wherein, as one preferable embodiment of the present invention, the base material can be a lump made of hydrosol or a hot-melt interlining cloth, and of course, the foregoing base material can also be made of other soluble materials; the said textile machine can be various types of machine or mechanical equipment which may perform pattern-woven, pattern-knitting or embroidery on a substrate, such as embroidery machine or quilting embroidery machine, etc.

(b) performing piece knitting: embroidering a corresponding pattern on the base material by the textile machine according to a set program, thereby obtaining a desirable semi-finished knitting piece; and (c) dissolving the base material: taking down the semi-finished knitting piece obtained in step (b) from the textile machine, then processing the semi-finished knitting piece and dissolving to remove the base material in the semi-finished knitting piece, thereby obtaining a desirable finished knitting piece.

In the present invention, when the base material prepared in the step (a) is a lump made of hydrosol, after being took down from the textile machine in the step (b), the semi-finished knitting piece is placed in water or an aqueous solution to dissolve and separate the base material from the semi-finished knitting piece. In order to better dissolve the base material, herein, as one preferable embodiment of the present invention, in the step (c), the water or aqueous solution has a temperature of 5-40° C. when the semi-finished knitting piece is put into water or an aqueous solution, and the semi-finished knitting piece is soaked in the water or aqueous solution for a period of 5-600 s. Further preferably, the water or aqueous solution temperature is 15-25° C., and the semi-finished knitting piece is soaked in the water or aqueous solution for a period of 250-400 s.

If the base material prepared in the step (a) is a hot-melt interlining cloth, in the step (c), after being took down from the textile machine, the semi-finished knitting piece is soaked in hot water or aqueous solution to dissolve and separate the base material from the semi-finished knitting piece. In order to better dissolve and remove the base material from the semi-finished knitting piece, preferably in the step (c), the hot water or aqueous solution has a temperature of 30-50° C. when the semi-finished knitting piece is put into the water or aqueous solution, and the soaking time is 30-1200 s. Further preferably, the hot water has a temperature of 35-45° C. when the semi-finished knitting piece is put into the water or aqueous solution, and the soaking time is 400-800 s. Of course, in addition to soaking the semi-finished knitting piece in the hot water or aqueous solution to dissolve the base material, other methods can be used to dissolve the base material. For example, after being took down from the textile machine in the step (c), the semi-finished knitting piece is subjected to ironing treatment to dissolve and separate the base material from the semi-finished knitting piece.

In order to enable the knitting piece manufactured by the fabrication process of the present invention to be more diversified, preferably, knitting threads used during the piece knitting by the textile machine in the step (b) are one or more of pure spinning yarn, blended yarn, ornamental thread, rope, webbing and stabilized yarn, wherein the pure spinning yarn can be cotton yarn, wool yarn, ramie yarn, schappe silk yarn, terylene, acrylic fibre and the likes, and the blended yarn can a blended yarn of the terylene and cotton, a blended yarn of wool and viscose and the likes. The textile machine can freely select different kinds of knitting threads according to the requirements of knitting piece patterns, thereby enabling the manufactured knitting piece to be more diversified and intensively changed in textures.

The above disclosures are merely preferable embodiments of the present invention, and technical solutions accomplishing the object of the present invention generally by the same means all fall within the protection scope of the present invention.

What is claimed is:

1. A fabrication process for manufacturing a knitting piece comprising:

(a) placing a soluble base material on a textile machine, wherein said soluble base material comprises a hot-melt interlining cloth;

(b) embroidering a corresponding pattern on said soluble base material using a knitting thread by said textile machine according to a set program to produce a semi-finished knitting piece, wherein said knitting thread comprises a stabilized yarn; and (c) removing said soluble base material from said semi-finished knitting piece to obtain a finished knitting piece.

2. The fabrication process of claim 1, wherein said process of removing said soluble base material comprises dissolving said soluble base material from said semi-finished knitting piece.

3. The fabrication process of claim 2 further comprising the steps of removing said semi-finished knitting piece obtained in step (b) from said textile machine prior to removing said soluble base material from said semi-finished knitting piece.

4. The fabrication process of claim 1, wherein said process of removing said soluble base material from said semi-finished knitting piece comprises placing said semi-finished knitting piece in water or an aqueous solution under conditions sufficient to dissolve said soluble base material.

5. The fabrication process of claim 4, wherein the temperature of said water or aqueous solution is in the range from 30° C. to 50° C.

6. The fabrication process of claim 5, wherein said semi-finished knitting piece placed in said water or aqueous solution for a period of from 30 seconds to 1200 seconds.

* * * * *